US012649994B2

(12) United States Patent
Miao et al.

(10) Patent No.: US 12,649,994 B2
(45) Date of Patent: Jun. 9, 2026

(54) CHISEL WITH DOUBLE LIMIT DISCS

(71) Applicant: JIANGSU WUYUANSU MACHINERY MANUFACTURING CO., LTD, Suzhou (CN)

(72) Inventors: Xiang Miao, Suzhou (CN); Pengcheng Qin, Suzhou (CN)

(73) Assignee: JIANGSU WUYUAN MACHINERY MANUFACTURING CO., LTD, Suzhou (CN)

( * ) Notice: Subject to any disclaimer, the term of this patent is extended or adjusted under 35 U.S.C. 154(b) by 842 days.

(21) Appl. No.: 18/067,828

(22) Filed: Dec. 19, 2022

(65) Prior Publication Data

US 2023/0116942 A1 Apr. 20, 2023

Related U.S. Application Data

(63) Continuation of application No. PCT/CN2021/079224, filed on Mar. 5, 2021.

(51) Int. Cl.
*E01C 23/06* (2006.01)
*E01C 23/088* (2006.01)

(52) U.S. Cl.
CPC ..... *E01C 23/065* (2013.01); *E01C 23/088* (2013.01)

(58) Field of Classification Search
CPC ..... E01C 23/065; E01C 23/088
See application file for complete search history.

(56) References Cited

U.S. PATENT DOCUMENTS 6,962,395 B2 * 11/2005 Mouthaan ..... E21C 35/197 299/103
2005/0173966 A1 * 8/2005 Mouthaan ..... E21C 35/197 299/104
2012/0013168 A1 * 1/2012 Sollami ..... E21C 35/18 299/105
2013/0026810 A1 * 1/2013 Ojanen ..... B28D 1/188 411/546
2023/0093644 A1 * 3/2023 Miao ..... B28D 1/188 299/113
2023/0116942 A1 * 4/2023 Miao ..... E21C 35/18 404/75

* cited by examiner

*Primary Examiner* — Nicole Coy

(57) ABSTRACT

Disclosed is a chisel with double limit discs. The chisel includes a holding seat and a bit mounted on the holding seat, the bit including a head and an extension provided on the lower side of the head, a first limit disc and a second limit disc arranged up and down are mounted between the holding seat and the head, the middle of the first limit disc having a first mounting through hole, and the middle of the second limit disc having a second mounting through hole, the second limit disc being partially concaved or partially convexed with the first limit disc. For the chisel, the service life of the holding seat and the bit are prolonged, the coaxiality between the chisel position and the holding seat position is maximized guaranteed, and the chisel may maintain the optimal rotary cutting performance during operation.

4 Claims, 7 Drawing Sheets

CHISEL WITH DOUBLE LIMIT DISCS

CROSS REFERENCE TO RELATED APPLICATION

This patent application is a continuation application of PCT/CN2021/079224, filed on Mar. 5, 2021, which claims the benefit and priority of Chinese Patent Application No. 202010720813.3 filed on Jul. 24, 2020, the disclosure of which is incorporated by reference herein in its entirety as part of the present application.

TECHNICAL FIELD

The present disclosure relates to a field of road maintenance equipment technologies, and specifically to a chisel with double limit discs.

BACKGROUND ART

The current chisel with a handle is applied in machinery equipments for ground maintenance, for example, on a milling drum of a road milling machine, a road surface recycling machine or similar machines; the tip of the chisel, as its main working part, is in direct contact with road base materials that need to be removed. Therefore, the structure of a chisel with a handle plays a key function in the cutting effect of the chisel. However, the chisel with a handle in the related art, due to its regular shape and component structure, rotates not smoothly in use, with an insufficient rotation speed, which causes eccentric wear, short service life, low usage of wear-resistant materials, and low work efficiency.

SUMMARY

The disclosure aims to provide a chisel with double limit discs that may increase the contact area between the limit disc and the holding seat, reduce the mutual pressure force, and prolong the service life of a chisel and a holding seat.

A chisel with double limit discs, includes a holding seat and a bit mounted on the holding seat, the bit including a head and an extension provided on the lower side of the head, the bottom of the head having a head support surface, and the upper end surface of the holding seat having a stress surface, a first limit disc and a second limit disc arranged up and down being mounted between the holding seat and the head, the middle of the first limit disc having a first mounting through hole, and the middle of the second limit disc having a second mounting through hole, the second limit disc being partially concaved or partially convexed with the first limit disc; the extension passing through the first mounting through hole and the second mounting through hole. Such an innovative bit mounting method is beneficial to increasing the contact area between the first limit disc and the second limit disc, reducing the mutual pressure force transmitted to a holding seat, and prolonging the service life of a chisel and a holding seat, and more importantly, the bit as a wearing part may be replaced frequently, while the holding portion needs to maintain a certain service life. During road operation, the portion of the holding seat in contact with the support surface of the bit is easily worn out under huge pressure and sliding friction. Considering such wear, the portion of the holding seat in contact with the support surface of the bit may be lengthened and thickened to make its service life longer. In the disclosure, double limit discs are arranged between the holding seat and the support surface of the bit. By selecting materials for the first limit disc and the second limit disc (for example, the first limit disc or the second limit disc is more easily worn out relative to the holding seat), a part of the wear of the holding seat is replaced by the first limit disc or the second limit disc, and the first limit disc or the second limit disc slides relative to each other, which also reduces the sliding friction force and sliding length of the holding seat and reduces the wear of the holding seat to a certain extent, to make its service life longer and reduce use cost.

Preferably, the second limit disc is partially concaved with the first limit disc; the lower side of the first limit disc has a lower surface and a positioning portion, the positioning portion being an annular convex arranged on the lower edge of the first mounting through hole; the upper side of the second limit disc has a force guide surface and a guide portion, the guide portion being an annular concave arranged along the upper edge of the second mounting through hole.

Preferably, the positioning portion of the first limit disc is matched with the guide portion of the second limit disc.

Preferably, a central axis L1 of the first mounting through hole coincides with a central axis L2 of the second mounting through hole; the first limit disc and the second limit disc are freely rotatable with each other around the central axis L1 or L2.

The first mounting through hole is the same as the second mounting through hole in diameter, and the first mounting through hole and the second mounting through hole are matched with an extension of the chisel.

Preferably, the upper surface of the first limit disc is in contact with the head support surface of the chisel; the lower surface of the first limit disc is in contact with the force guide surface of the second limit disc (beneficial to increasing the contact area between the first limit disc and the second limit disc, reducing the mutual pressure force, and prolonging the service life of a chisel and a holding seat, the same applies to other contact surfaces). The support surface of the second limit disc is in contact with the stress surface of the holding seat.

Preferably, the lower side of the second limit disc is provided with an concave portion along the second mounting through hole, and the concave portion includes an inner upper limit surface and an outer sloped transition surface.

Preferably, the upper end surface of the holding seat has a support portion with an annular convex, the support portion is matched embedded in the concave portion, and there is a clearance between the support portion and the concave portion. In terms of relative movement, the holding seat is "fixed", in this case, the support portion of the holding seat is also "fixed", and the concave portion of the second limit disc is engaged with the support portion of the holding seat to maximize the coaxiality with the position of the holding seat. The clearance may avoid the problem that the support surface cannot contact the stress surface due to machining errors. When the working pressure on the chisel and the limit disc cannot not be effectively transmitted to the holding seat, the chisel and the chisel limit disc are greatly affected in service life, and will be quickly damaged under large impact force. Similarly, the transition surface of the second limit disc is preferably in a clearance fit state with a guide surface of the holding seat, so that the concave portion of the second limit disc completely embraces the support portion of the holding seat, and the chisel limit disc and the holding seat may quickly return to the original relative position after separated to a certain extent during operation without jamming when the limit disc is rotated.

Preferably, the lower side of the second limit disc is provided with a convex portion along the second mounting through hole, the upper end surface of the holding seat has a concave support portion, the convex portion is matched embedded in the support portion, and there is a clearance between the convex portion and the support portion.

Compared with the related art, the disclosure has the following beneficial effects:

In the disclosure, for a chisel with double limit discs, a second limit disc is partially concaved or partially convexed with a first limit disc, and such an innovative bit mounting method is beneficial to increasing the contact area of the first limit disc and the second limit disc and reducing the mutual pressure force transmitted to a holding seat, and a part of the wear of the holding seat is replaced by the first limit disc or the second limit disc, which prolongs the service life of a holding seat and a bit; and the concave portion of the second limit disc completely embraces the support portion of the holding seat, to maximized guarantee the coaxiality between the chisel position and the holding seat position, and the chisel may maintain the optimal rotary cutting performance during operation.

DETAILED DESCRIPTION OF THE EMBODIMENTS

Figure 1:
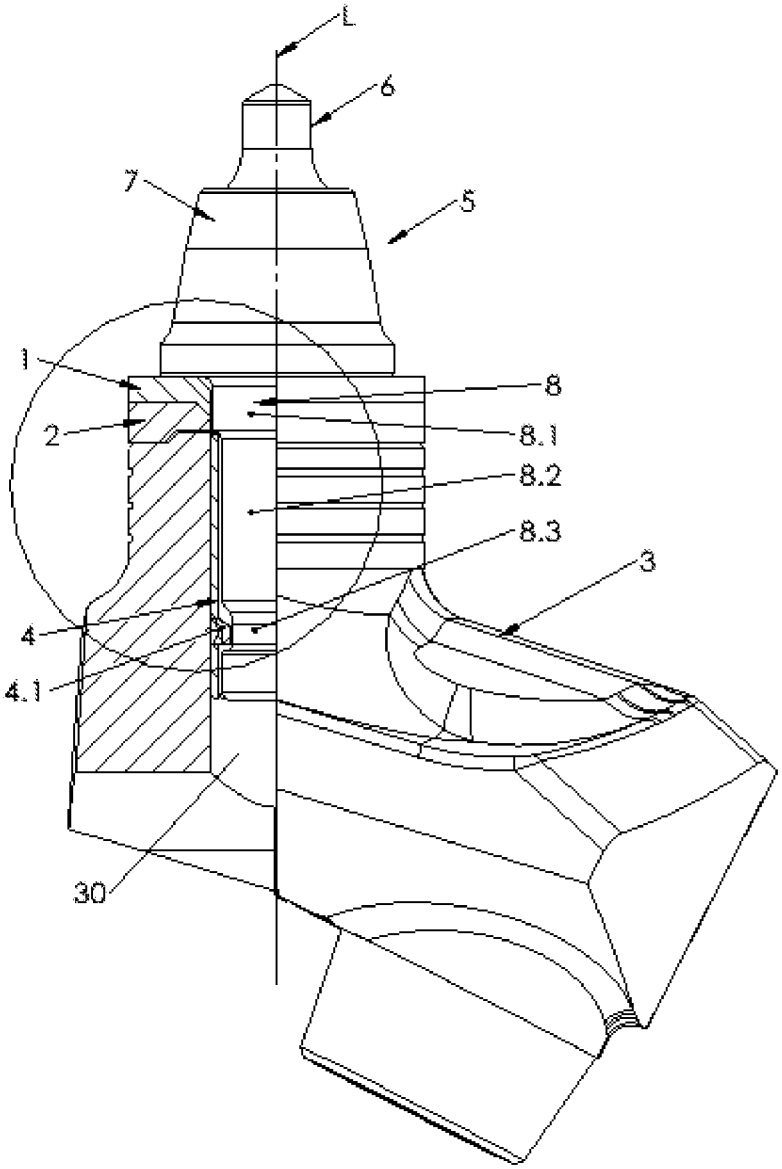
FIG. 1 is a semi-sectional view of a chisel with double limit discs mounted in a holding seat in the disclosure.
Figure 2:
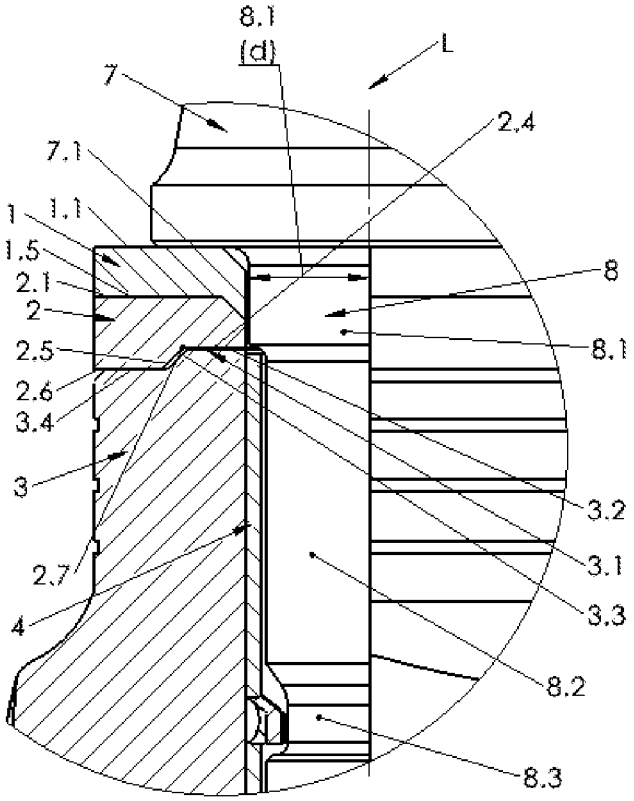
FIG. 2 is an enlarged view of a partial sectional view A in FIG. 1.
Figure 3:
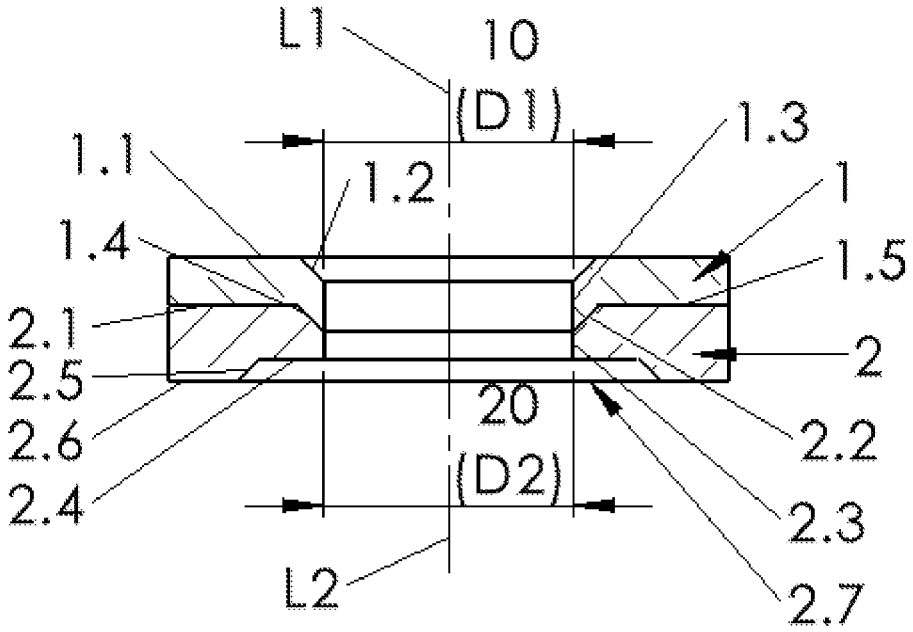
FIG. 3 is a side full sectional view of a combined structure of a first limit disc and a second limit disc in FIG. 1.
Figure 4:
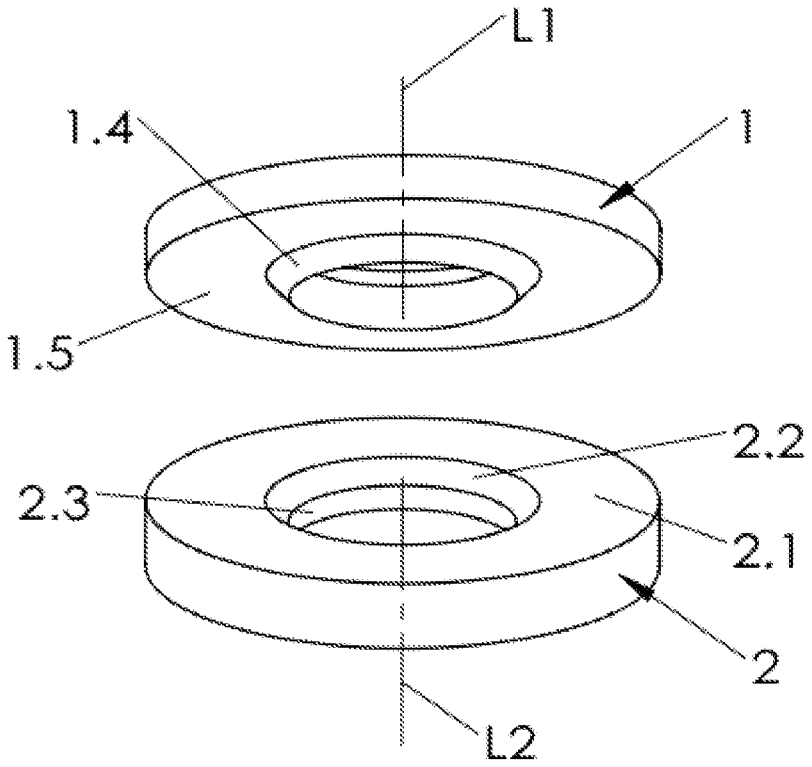
FIG. 4 is an exploded view of a combined structure of a first limit disc and a second limit disc in FIG. 1.
Figure 5:
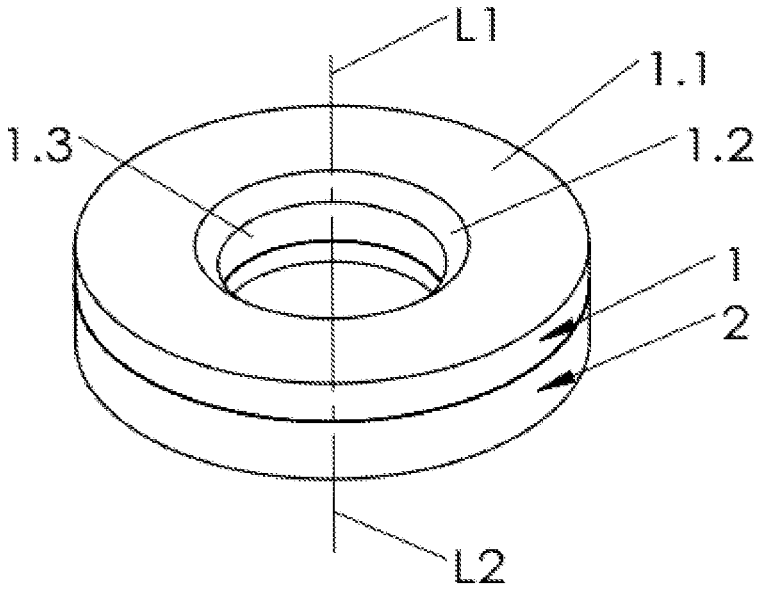
FIG. 5 is a schematic diagram of an upper structure of a combined structure of a first limit disc and a second limit disc in FIG. 1.
Figure 6:
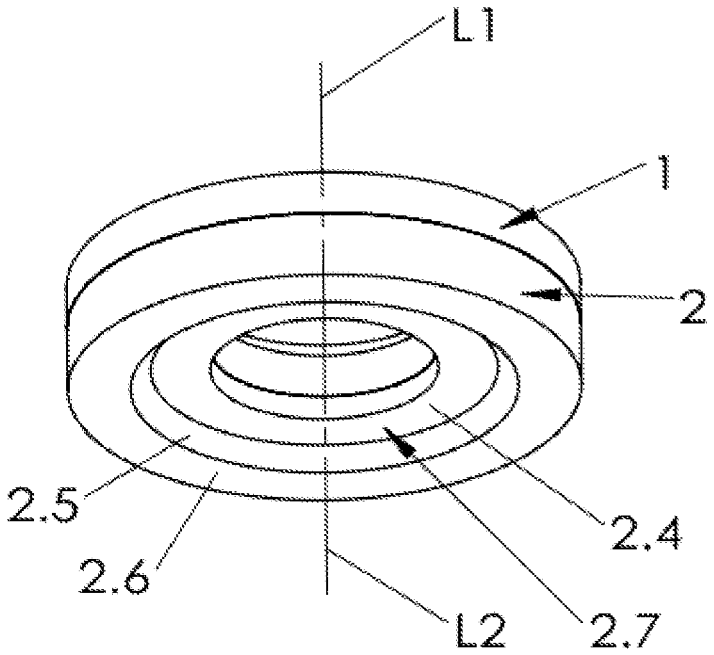
FIG. 6 is a schematic diagram of a bottom structure of a combined structure of a first limit disc and a second limit disc in FIG. 1.
Figure 7:
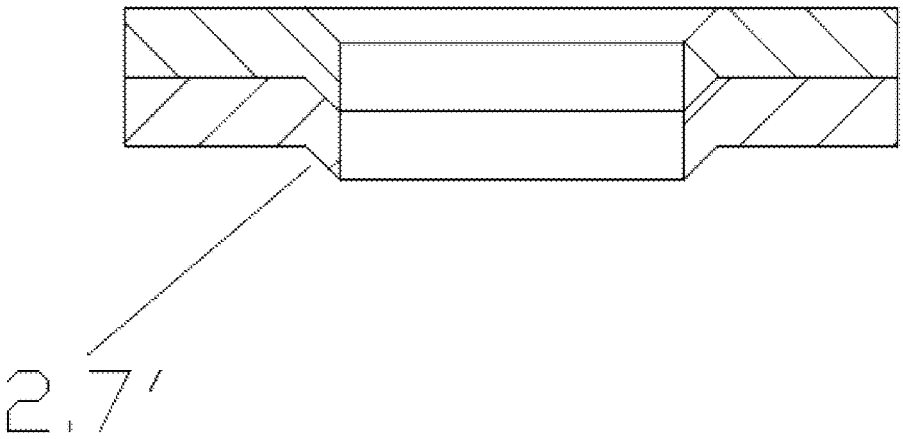
FIG. 7 is a side full sectional view of another embodiment of the disclosure.

FIGS. 1 and 2 illustrate a front side view of a chisel 5 with double limit discs mounted in a holding seat 3. The chisel 5 includes a top 6 made of tungsten-cobalt-based cemented carbide and permanently fixed in a blind hole-shaped molten pool of a chisel head 7 by brazing. The chisel extension 8 extends below the chisel head 7 and is formed by a cylinder with a diameter less than that of the chisel head 7. A first limit disc 1 and a second limit disc 2 are sleeved on the holding portion 8.1 of the chisel extension 8, the upper surface 1.1 of the first limit disc 1 is against the support surface 7.1 of the chisel head 7, and the support surface 2.6 of the second limit disc 2 is against the convex torus 3.2 of the holding seat 3. The steel fastening sleeve 4 is usually rolled by a thin steel sheet, with certain elasticity, is provided with an opening, with an appropriate length, and is sleeved on a second holding handle 8.2 of the chisel extension 8. A plurality of inner recesses 4.1 are processed on the surface using a stamping process and matched in the groove 8.3 of the holding handle, the steel fastening sleeve 4 is pressed into the mounting through hole 30 of the holding seat 3, and the outer side surface is expanded and pressed into the mounting through hole 30 of the holding seat 3 by maintaining fixed contact.

FIG. 2 enlarges a partial sectional view A in FIG. 1, in which the first limit disc 1, the second limit disc 2, the holding seat 3 and the steel fastening sleeve 4 are shown in a semi-sectional view. As illustrated in FIG. 2, in the actual working state, the concave portion 2.7 of the limit disc 2 is configured to be engaged with the support portion 3.1 of the holding seat 3. The upper limit surface 2.4 is in a clearance fit state with the convex torus 3.2, the clearance value being within 0.4 mm to 2.9 mm, and the transition surface 2.5 is in a clearance fit state with the guide surface 3.3, and the support surface 2.6 is in contact fit with the stress surface 3.4, which eliminates dimension errors due to machining. In the working process, it may be deemed that the holding seat 3 is relatively stationary, when the first limit disc 1 and the second limit disc 2 are rotated around the holding seat 3, the central axes L1 and L2 of the first limit disc 1 and the second limit dis 2 are rotated around the central axis L of the holding seat 3.

Then as illustrated in FIGS. 1 and 2, the support portion 3.1 of the holding seat 3 extends out from one side of the stress surface 3.4 to form a circular boss shape, with the convex torus 3.2 as a termination surface in the length direction and the guide surface 3.2 as a termination surface in the diameter direction, and form a mounting through hole 30 around the central axis L of the holding portion 3 for a steel fastening sleeve 4 for accommodating a chisel 5, a second holding handle 8.2 and a third holding handle 8.3.

As can be seen from FIGS. 2 to 6, a first holding handle 8.1 of the extension 8 of the chisel 5 has a diameter dl ranging from 15 mm to 25 mm. The first limit disc 1 has a mounting through hole 10 having a diameter D1 ranging from 16 mm to 26 mm; the second limit disc 2 has a mounting through hole 20 having a diameter D2 ranging from 16 mm to 26 mm, and the first holding handle 8.1 of the extension 8 of the chisel 5 is mounted in the mounting through holes 10 and 20 of the first limit disc 1 and the second limit disc 2. The positioning portion 1.4 of the first limit disc 1 is interlocked with the guide portion 2.2 of the second limit disc 2. The lower surface 1.5 of the first limit disc 1 is configured in contact fit with the force guide surface 2.1 of the second limit disc 2. The central axis L1 of the mounting through hole 10 of the first limit disc 1 is arranged coaxially with the central axis L2 of the mounting through hole 20 of the second limit disc 2. The first limit disc 1 and the second limit disc 2 are freely rotatable with each other around the central axis L1. The concave portion c of the second limit disc 2 is formed by surrounding the upper limit surface 2.4 and the transition surface 2.5. By such a design, the chisel 5 maintains coaxiality with the central axis L of the holding seat 3 to the greatest extent during a rotation process, to improve the use performance and service life of the chisel 5.

The chisel 5 needs to keep rotating at high speed in the mounting through hole 30 of the holding seat 3. For this purpose, the chisel 5 needs to maintain coaxiality with the central axis L1 of the holding seat 3 to the greatest extent during a rotation process, which is beneficial to improving the use performance of the chisel 5, therefore, the first limit disc 1 and the second limit disc 2 may increase the contact area of the limit disc and the holding seat, reduce the mutual pressure force, and prolong the service life of a chisel and a holding seat, and achieve the beneficial effects of the disclosure.

Embodiment 2

Similar to Embodiment 1, the difference relies on that the lower side of the second limit disc is provided with a convex portion 2.7' along the second mounting through hole, in this case, the upper end surface of the holding seat has a concave support portion, the convex portion is matched embedded in the support portion, and there is a clearance between the convex portion and the support portion.

It should be noted that, the attached drawings of the embodiments are all in a very simplified form and use inaccurate ratios, and are only used for assisting in explaining embodiments of the disclosure conveniently and clearly.

Although an implementation solution of the disclosure has been disclosed as above, it is not limited to the applications listed in description and implementation, and may be applied to various fields suitable for the disclosure. Additional changes may be easily made for those skilled in the art. Therefore, the disclosure is not limited to specific details and illustrations shown and described herein without departing from the general concepts defined by appended claims and equivalent scopes.

What is claimed is:

1. A chisel (5) with double limit discs, comprising a holding seat (3) and a bit mounted on the holding seat (3), the bit comprising a head (7) and an extension (8) provided on the lower side of the head (7), the bottom of the head (7) having a head support surface (7.1), and the upper end surface of the holding seat (3) having a stress surface (3.4), wherein, a first limit disc (1) and a second limit disc (2) arranged up and down are mounted between the holding seat (3) and the head (7), the middle of the first limit disc (1) having a first mounting through hole (10), and the middle of the second limit disc (2) having a second mounting through hole (20), the second limit disc (2) being partially concaved or partially convexed with the first limit disc (1); the extension (8) passes through the first mounting through hole (10) and the second mounting through hole (20);

wherein, the second limit disc (2) is partially concaved with the first limit disc (1); the lower side of the first limit disc (1) has a lower surface (1.5) and a positioning portion (1.4), the positioning portion (1.4) being an annular convex arranged on the lower edge of the first mounting through hole (10); the upper side of the second limit disc (2) has a force guide surface (2.1) and a guide portion (2.2), the guide portion (2.2) being an annular concave arranged along the upper edge of the second mounting through hole (20); the lower surface of the second limit disc (2) has an annular support surface (2.6);

wherein, the upper surface (I.I) of the first limit disc (1) is in contact with the head support surface (7.1) of the chisel (5); the lower surface (1.5) of the first limit disc (1) is in contact with the force guide surface (2.1) of the second limit disc (2), and the support surface (2.6) of the second limit disc (2) is in contact with the stress surface (3.4) of the holding seat (3);

wherein, the lower side of the second limit disc (2) is provided with a convex portion (2.7') along the second mounting through hole (20), the upper end surface of the holding seat (3) has a concave support portion, the convex portion (2.7') is matched embedded in the support portion, and there is a clearance between the convex portion (2.7') and the support portion.

2. The chisel (5) of claim 1, wherein, the positioning portion (1.4) of the first limit disc (1) is matched with the guide portion (2.2) of the second limit disc (2).

3. The chisel (5) of claim 2, wherein, a central axis L1 of the first mounting through hole (10) coincides with a central axis L2 of the second mounting through hole (20); the first limit disc (1) and the second limit disc (2) are freely rotatable with each other around the central axis L1 or L2.

4. The chisel (5) of claim 3, wherein, the first mounting through hole (10) is the same as the second mounting through hole (20) in diameter, and the first mounting through hole (10) and the second mounting through hole (20) are matched with an extension (8) of the chisel (5).

* * * * *